United States Patent [19]

Zaremski et al.

[11] 4,026,777

[45] May 31, 1977

[54] METALLIC DESCALING SYSTEM

[75] Inventors: Donald R. Zaremski, Cheswick, Pa.; Albert Krepler, Vienna, Austria

[73] Assignees: Allegheny Ludlum Industries, Inc., Pittsburgh, Pa.; Ruthner Industrieanlagen Aktiengasellschaft, Vienna, Austria

[22] Filed: Apr. 1, 1976

[21] Appl. No.: 672,586

[52] U.S. Cl. ..... 204/141.5; 134/26; 204/145 R

[51] Int. Cl.[2] ..... C25F 1/06; C25F 1/02

[58] Field of Search ..... 204/141.5, 145 R, 145 F; 134/3, 26

[56] References Cited

UNITED STATES PATENTS

| | | | |
|---|---|---|---|
| 3,043,758 | 7/1962 | Machu et al. | 204/145 R |
| 3,260,619 | 7/1966 | Shoemaker et al. | 134/3 |
| 3,721,626 | 3/1976 | Stanek et al. | 204/145 R |

*Primary Examiner*—T. M. Tufariello

*Attorney, Agent, or Firm*—Vincent G. Gioia; Robert F. Dropkin

[57] ABSTRACT

A process for descaling a metallic body, wherein the body is immersed in a bath of a molten oxidizing salt, and subsequently in an electrolyte of an aqueous solution of at least one neutral salt from the group consisting of the chloride, sulfate and nitrate of an alkali metal or ammonium.

5 Claims, No Drawings

METALLIC DESCALING SYSTEM

The present invention relates to a metallic descaling process.

As anneals and other heat treatments are often carried out in oxidizing atmospheres, oxide scales are known to form on metallic surfaces.

To date, several methods of removing such scales are in commercial use. These methods do, however, necessitate the use of hot mineral acid solutions. Typical methods are disclosed in U.S. Pat. Nos. 3,043,758 and 3,260,619.

Today it is becoming increasingly clear, that there is a need for a descaling process which requires little or no acid pickling. First of all, both the cost of using and of disposing of mineral acids has significantly increased. Secondly, with the continuing tightening of pollution laws, there is a distinct possibility that the dumping of waste acid pickling solutions will not be permitted at some time in the future. Should this occur, metal producers would be forced to install very costly acid regeneration or neutralization plants.

The present invention provides a scale removal system which eliminates or minimizes the need for acid pickling. Applicants have found that such a desirable result could be achieved by immersing a scaled metallic body in a molten oxidizing salt and then in an electrolyte on the order of that disclosed in U.S. Pat. No. 3,043,758. Such a process is contradictory to the teachings of U.S. Pat. No. 3,043,758, as said patent does not hint upon the use of a molten oxidizing salt; and to that of U.S. Pat. No. 3,260,619, as said patent does not hint upon the use of an electrolyte with its molten oxidizing salt.

It is accordingly an object of the present invention to provide a metallic descaling process which eliminates or minimizes the need for acid pickling.

The present invention provides a process for descaling metallic bodies. In its broadest sense, it comprises the steps of: immersing a metallic body in a bath of a molten oxidizing salt; and subsequently in an electrolyte of an aqueous solution of a least one neutral salt from the group consisting of the chloride, sulfate and nitrate of an alkali metal or ammonium.

The molten oxidizing salt conditions the scale for subsequent removal. Of the molten oxidizing salts in use, the most widely accepted contain a compound from the group consisting of sodium nitrate and potassium nitrate. Three typical salts are as follows:

| A | B | C |
|---|---|---|
| 62% NaOH<br>32% $NaNO_3$<br>6% NaCl | 63% NaOH<br>15% KOH<br>12% $NaNO_3$<br>10% NaCl | 62–89% NaOH<br>11–38% $NaNO_3$ |

Immersion time in the molten salt is at least 30 seconds, and generally in excess of 45 seconds. Times are dependent upon the size of the body being descaled, as well as the type and thickness of the scale, and the temperature of the molten salt.

Subsequent to being immersed in the molten salt, the metal being treated is immersed in the electrolyte described hereinabove. Immersion time in the electrolyte is at least 4 seconds, and generally at least 10. As with the molten oxidizing salt, immersion times are dependent upon the size of the body being descaled, as well as the type and thickness of the scale, and the temperature of the electrolyte. With the electrolyte, times are also dependent upon the current density and upon the time the metal is anodic. Current densities are usually in excess of 0.1 amp per square inch. Electrolyte temperatures are usually in the range of from 120 to 200° F. Current densities, temperatures and times are all, however, dependent upon each other, as well as upon the other listed variables. To increase the effectiveness of the electrolyte, 0.1 to 50 grams per liter of a compound from the group consisting of fluorides, chlorides, perchlorates, chromates, nitrites, sulfites, nitrates and sulfates may be added. The pH of the electrolyte is maintained between 1.0 to 7.0 during the electrolytic process.

Although the invention is believed to be adaptable to a number of metals, alloy steels presently appear to constitute the most significant embodiment thereof. For this reason, the following examples are directed to the removal of scale from stainless steel.

Samples of mill annealed Type 304 and 309 stainless steel were exposed to scale conditioning in a molten oxidizing salt of the following chemistry:

62% NaOH, 32% $NaNO_3$, 6% NaCl.

and then, after rinsing, to a neutral sodium sulfate electrolyte. The solution concentration of sodium sulfate was between 15 and 20% by weight. The molten salt was maintained at a temperature of from 900 to 950° F whereas the electrolyte was maintained at a temperature of from 150° to 170° F. Specifics as to metal gage, times, current densities and polarities are set forth hereinbelow in Table I.

TABLE I

| | | | SALT | ELECTROLYTE | | | |
|---|---|---|---|---|---|---|---|
| | | | | | Time of Immersion (seconds) | | |
| Sample | Type | Gage (inches) | Time of Immersion (seconds) | Current Density (amp/sq.in.) | Anode | Cathode | Anode |
| A | 304 | 0.030 | 60 | ½ | 9 | 9 | 9 |
| B | 304 | 0.060 | 60 | ½ | 9 | 9 | 9 |
| C | 309 | 0.018 | 60 | ½ | 18 | 18 | 18 |
| D | 304 | 0.060 | 60 | ½ | 21 | 21 | 21 |
| E | 304 | 0.030 | 60 | ½ | 30 | 30 | 30 |

Samples removed from the electrolyte were cleaned and examined for residual scale at a magnification of 20X. The results of the examination appear hereinbelow in Table II. Also appearing in Table II are the results of a salt spray test. The samples were placed in a salt spray cabinet for seven days and subsequently examined for rust. Corrosion resistance of sample is somewhat impaired if scale is not removed.

TABLE II

| Sample | Scale (%) | Salt Spray (% Rust) |
|---|---|---|
| A | 0 | 0 |
| B | 0 | 0.02 |

TABLE II-continued

| Sample | Scale (%) | Salt Spray (% Rust) |
|---|---|---|
| C | 0 | 0 |
| D | 0 | 0.30 |
| E | 0 | 0.05 |

The results appearing hereinabove in Table II clearly show that metallic surfaces can be effectively descaled in accordance with the teachings of the present invention. Scale was not detected on the samples at a magnification of 20X. Moreover, salt spray results showed an insignificant rate of attack, if any.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. A process for descaling a metallic body, which comprises the steps of: immersing said body in a bath of a molten oxidizing salt; maintaining said bath at a temperature above its melting point during said immersion, said immersion being for a period of at least 30 seconds; removing said body from said bath after scale on said body has been conditioned for subsequent removal; subsequently immersing said body in an electrolyte of an aqueous solution of at least one neutral salt from the group consisting of the chloride, sulfate and nitrate of an alkali metal or ammonium; passing an electric current through said body and electrolyte for a period of at least 4 seconds; and removing said body from said electrolyte.

2. A process according to claim 1, wherein said bath contains a compound from the group consisting of potassium nitrate and sodium nitrate.

3. A process according to claim 1, wherein said electrolyte contains from 0.1 to 50 grams per liter of a compound from the group consisting of fluorides, chlorides, perchlorates, chromates, nitrites, sulfites, nitrates and sulfates.

4. A process according to claim 1, wherein the neutral salt is sodium sulfate.

5. A process according to claim 1, wherein said metallic body is an alloy steel.

* * * * *